US006892495B2

(12) United States Patent
Burdach

(10) Patent No.: US 6,892,495 B2
(45) Date of Patent: May 17, 2005

(54) BRAKING SYSTEM FOR A VEHICLE MANUAL WINDOW-LIFTING MECHANISM

(75) Inventor: Karsten Albrecht Burdach, Martos (ES)

(73) Assignee: ArvinMeritor LVS Espana, S.A. (ES)

( * ) Notice: Subject to any disclaimer, the term of this patent is extended or adjusted under 35 U.S.C. 154(b) by 52 days.

(21) Appl. No.: 10/462,570

(22) Filed: Jun. 16, 2003

(65) Prior Publication Data

US 2004/0250473 A1 Dec. 16, 2004

(51) Int. Cl.[7] ..... E05F 11/38; E05F 11/48

(52) U.S. Cl. ..... 49/348; 49/352

(58) Field of Search ..... 49/348, 352, 139, 49/141, 502, 246, 339, 341–345; 74/543–547, 89, 14, 89.16–89.18, 89.2, 89.22, 545, 505, 625, 606 R; 192/223, 223.4, 223.2

(56) References Cited

U.S. PATENT DOCUMENTS

| | | | | | |
|---|---|---|---|---|---|
| 1,770,449 | A | | 7/1930 | Ackerman et al. | |
| 2,001,758 | A | | 5/1935 | Zwierzina | |
| 3,110,380 | A | | 11/1963 | Meyer et al. | |
| 4,191,060 | A | * | 3/1980 | Sessa | 74/89.22 |
| 4,499,787 | A | * | 2/1985 | Leistner et al. | 74/625 |
| 4,503,732 | A | * | 3/1985 | Schust | 74/625 |
| 4,928,547 | A | * | 5/1990 | Huyer | 74/545 |
| 5,199,310 | A | * | 4/1993 | Yoshimura | 74/89.2 |
| 5,279,468 | A | * | 1/1994 | Kuster | 49/352 |
| 5,987,819 | A | * | 11/1999 | Smith | 49/352 |
| 6,006,473 | A | * | 12/1999 | Mariel et al. | 49/139 |
| 6,655,089 | B2 | * | 12/2003 | Le Gallo | 49/352 |

FOREIGN PATENT DOCUMENTS

| | | | |
|---|---|---|---|
| DE | 29723085 U1 * | 3/1998 | E05F/00/00 |
| ES | 2 003 632 | 11/1988 | |
| ES | 2 003 633 | 11/1988 | |
| ES | 200001096 | 11/2002 | |

OTHER PUBLICATIONS

Search report, Spanish Patent Office, dated Oct. 18, 2002.

* cited by examiner

*Primary Examiner*—Hugh B. Thompson, II
(74) *Attorney, Agent, or Firm*—Carlson, Gaskey & Olds

(57) ABSTRACT

A braking system for a vehicle manual window-lifting mechanism prevents a window from dropping as a consequence of vibrations and minimizes angular play in a crank shaft. The system includes a helical spring that assists the crank shaft and that has a geometry modified from its conventional design. An included angle between the radial side pieces at which the winding ends terminate is an acute angle. One of the side pieces is coupled inside a radial hollow of the crank-driven shaft itself. The other side piece is located between the crank shaft and the drum, which rotate relative to each other. As a result, instead of the usual 40° or 45° of free play, the invention allows a maximum free play of only 10° to 15° in the crank shaft.

8 Claims, 5 Drawing Sheets

A-A

B-B

BRAKING SYSTEM FOR A VEHICLE MANUAL WINDOW-LIFTING MECHANISM

TECHNICAL FIELD

The present invention is directed to a braking system for a vehicle manual window-lifting mechanism.

BACKGROUND OF THE INVENTION

Most assembly specifications for window-operating handles specify a maximum free radial play in the shaft of the crank that drives the regulator for manual window opening on the order of 45° as a maximum, and often less than 30°. Most current manual control systems do not comply with this specification. Furthermore, current mechanisms allow the window to drop too quickly during irreversibility tests, very often beyond the specified limit.

Currently, the crank shaft and the cable-winding drum on which it is mounted with relative rotation are assisted by a helical spring that allows excessive free play in the crank shaft (on the order of 40° to 45°) before the drum is driven. The braking operation of the gearbox is realized in both directions of rotation of the crank shaft, that is, directions for both opening and closing of the window.

There is a desire for a system that can minimize free play in the crank shaft and prevents the window from dropping too quickly.

SUMMARY OF THE INVENTION

The invention is generally directed to a braking system for a vehicle manual window-lifting mechanism that prevents the window from dropping as a consequence of vibrations and minimizes angular play in the crank shaft.

To achieve the proposed advantageous effects according to one embodiment of the invention, the inventive structure includes a helical spring that assists the crank shaft and that has a geometry modified from its conventional design. The included angle between the radial side pieces with which the winding ends terminate is an acute angle. One of the side pieces is coupled inside a radial hollow of the crank-driven shaft itself. The other side piece is located between the crank shaft and the drum, which rotate relative to each other.

BRIEF DESCRIPTION OF THE DRAWINGS

Several pages of drawings are attached to facilitate understanding of the characteristics of the invention, and these form an integral part of this descriptive statement. The figures are meant to be illustrative and not limiting in any way.

DETAILED DESCRIPTION OF THE EMBODIMENTS

Figure 1:
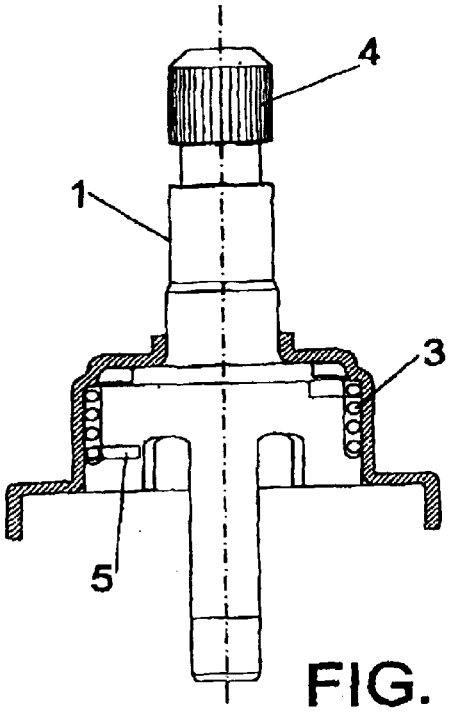
FIG. 1 is a longitudinal elevation of the crank-driven shaft mounted on the window-raising drum according to one embodiment, wherein the gearbox that drives the mechanism being shown in section.
Figure 2:
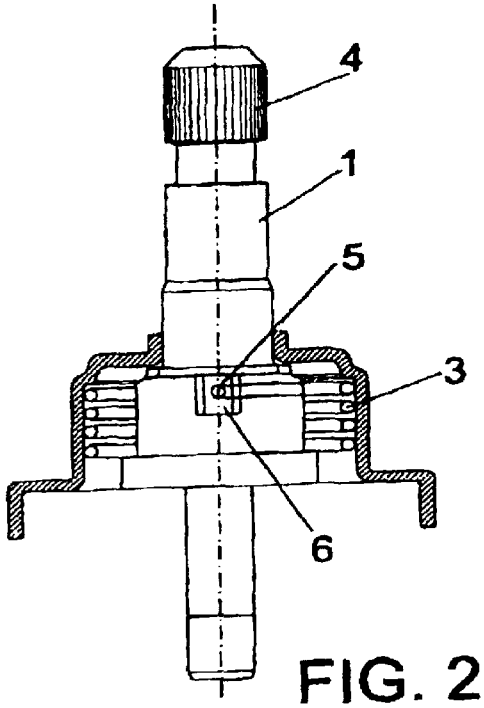
FIG. 2 is a sectioned side elevation of FIG. 1.
Figure 3:
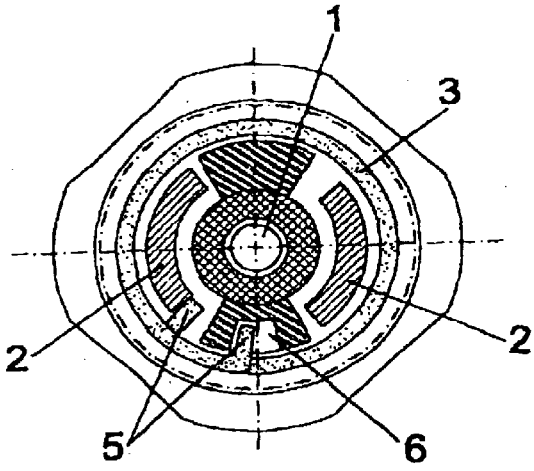
FIG. 3 is a plan view of what is shown in FIG. 2.
Figure 4:
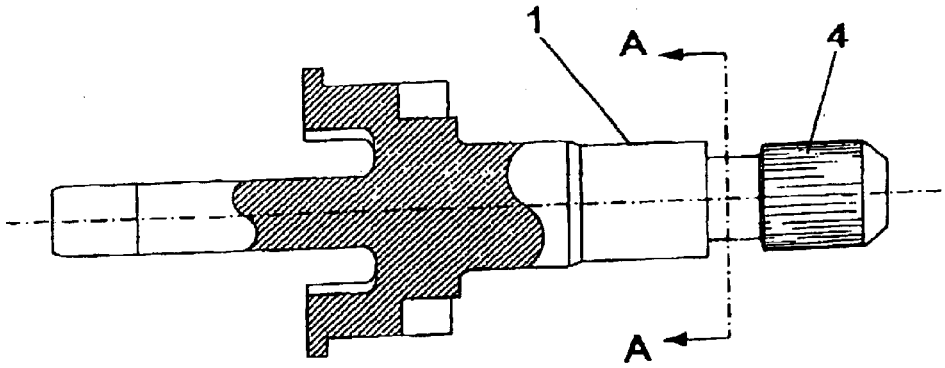
FIG. 4 is a longitudinal view of the crank shaft.
Figure 5:
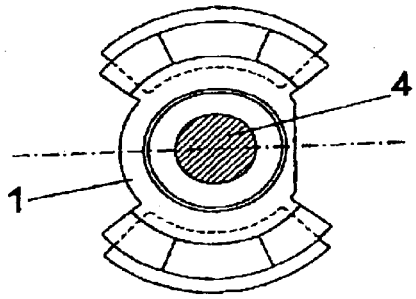
FIG. 5 is a section along line A—A of FIG. 4.

Referring to the Figures, the braking system for a vehicle manual window-lifting mechanism according to one embodiment of the invention includes a crank shaft 1 mounted coaxially with respect to a drum 2, these elements 1, and 2 being coaxially surrounded by a helical spring 3, such as a helical spring. An end 4 of a crank (not shown) connecting to the crank shaft 1 is splined along its length.

Figure 6:
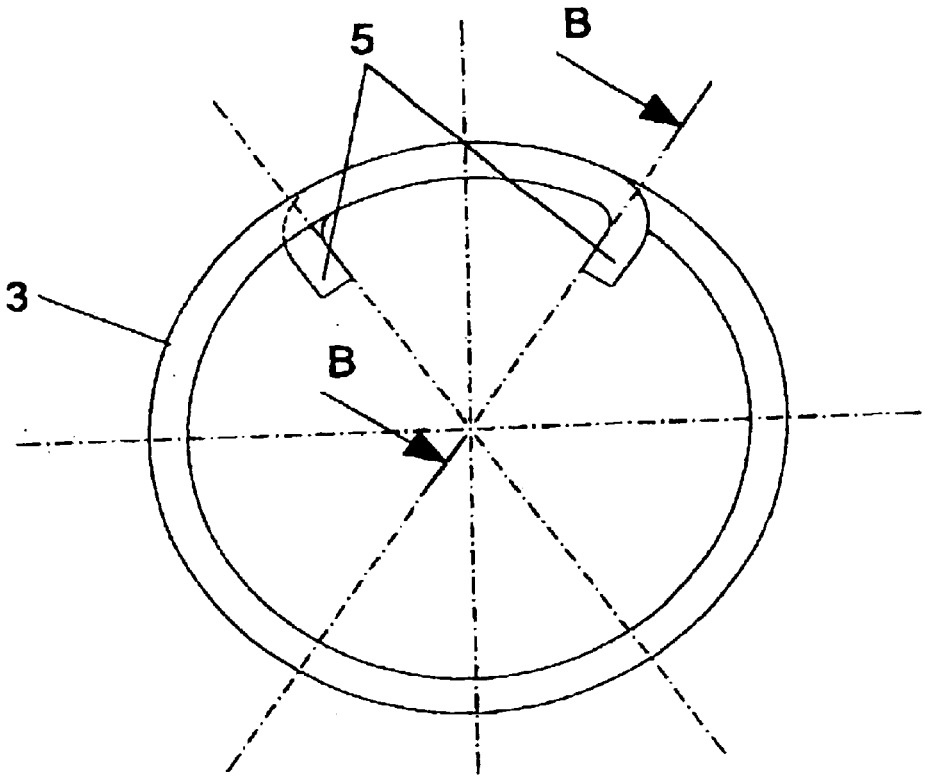
FIG. 6 is a plan view of the helical spring.
Figure 7:
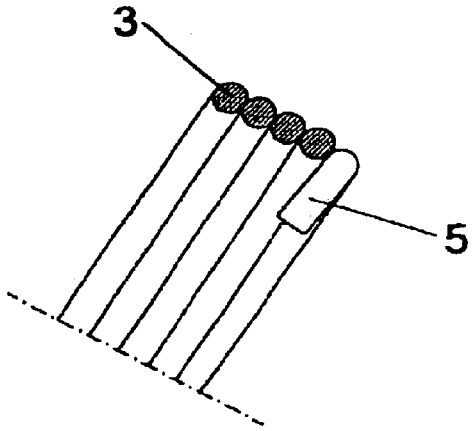
FIG. 7 is a section along line B—B of FIG. 6.

FIGS. 6 and 7 show a design geometry of the helical spring 3 according to one embodiment. The ends of the helical spring 3 are provided with respective inwardly directed radial side pieces 5.

Figure 8:
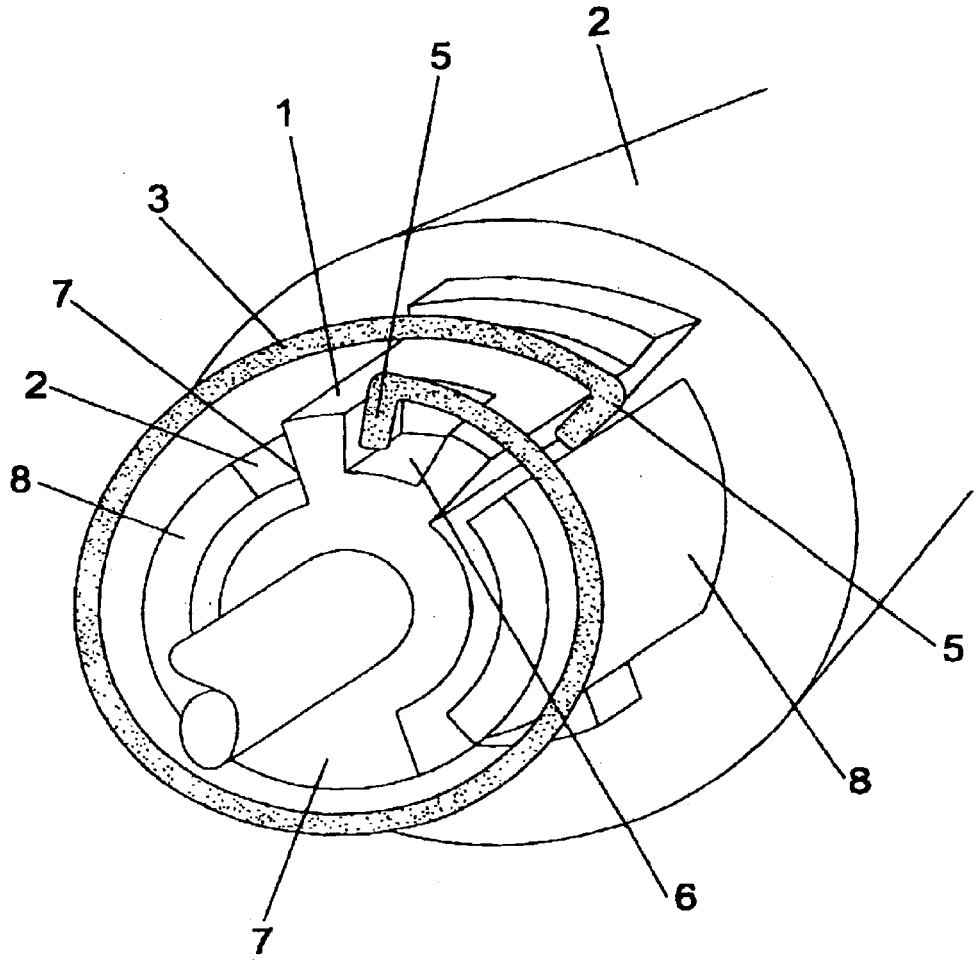
FIG. 8 is a schematic oblique view of the helical spring mounted on the crank shaft.

FIG. 8 shows the location of the radial side pieces 5 and a schematic representation of the winding of the helical spring 3. One of the radial side pieces 5 fits loosely in a radial hollow slot 6 of one of two diametrically opposite sections 7 that define widened zones of the crank shaft 1. The other radial side piece 5 of the helical spring 3 is arranged in the radial space defined between shaft 1 and drum 2, and more particularly between the widened part of the crank shaft 1 and one of the two facing axial projections 8 of the drum 2.

Figure 9:
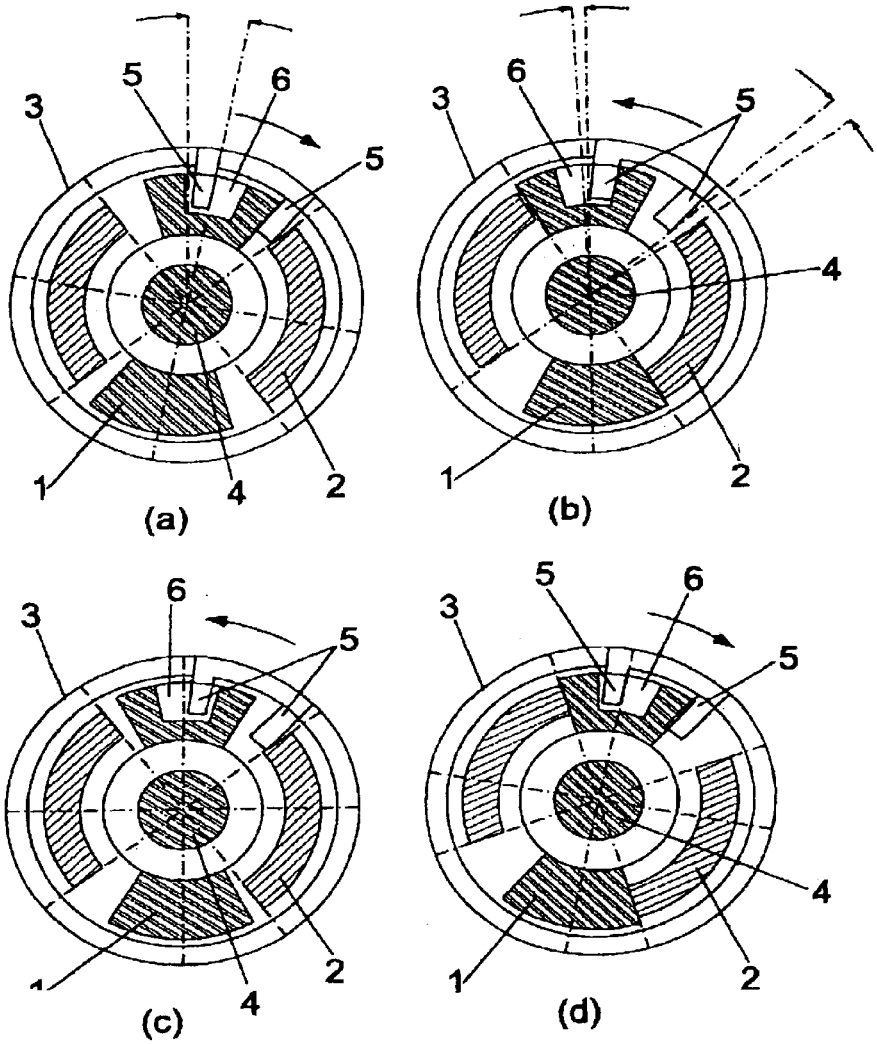
FIG. 9 is a diagram of operation for observing the relative positions between the crank shaft and the drum, driven by the helical spring, in four relative positions.

FIG. 9 schematically shows different sequential positions of the functioning of the mechanism. As can be seen in the Figure, in position a) the crank shaft 1 compresses the spring 3 and, at the same time, makes the drum 2 rotate when the crank shaft 1 turns to the right in a window-closing direction.

In position b), the crank shaft 1 rotates in an opposite, window-opening direction. The left radial side piece 5 of the helical spring 3 moves freely in the radial hollow slot 6 formed in one of the extensions 7 of crank shaft 1 and moves until it makes contact with the opposite side of the slot 6. The helical spring 3 is then compressed before the drum 2 can touch the right radial side piece 5 (i.e., minimum functional play), which would cause the system to brake.

In position c), when the drum 2 is driven directly in the window opening direction, the drum 2 contacts the right radial side piece 5 of the helical spring 3 due to expansion of the helical spring 3 before the crank shaft 1 can compress the helical spring 3 and cause the system to brake.

Finally, in position d) of FIG. 9, when the drum 2 is directly driven in the opposite direction (i.e., in the window-closing direction), the drum contacts the crank shaft 1, causing the helical spring 3 to be compressed. The system does not brake, and the window can be raised. This represents a great advantage in the case of a defective window raiser because the structure makes it possible to bring the window to the top position and block it once it reaches this position.

In other words, in position a) of FIG. 9, the crank shaft 1 is driven, compressing the helical spring 3. The drum 2 moves clockwise in the window-closing direction. If an attempt is made to rotate the drum 2 in the window-opening direction after the window is closed, the helical spring 3 will be immediately extended, allowing no free play, and the system brakes.

In position b), the crank shaft 1 has been driven and the helical spring 3 is compressed. The drum 2 moves counterclockwise, in the window-opening direction. Position c) shows when the drum 2 is driven. The helical spring 3 is extended, activating the braking function in the system. The drum 2 tries to move counterclockwise. Finally, in position d), the drum is driven, compressing the helical spring 3. The drum 2 conducts the crank shaft 1 clockwise.

In summary, the crank shaft 1 is engaged in positions a) and b) of FIG. 9. By contrast, the drum that is engaged in positions c) and d). As a result, instead of the usual 40° or 45° of free play, the acute angle in the winding ends of the helical spring allows a maximum free play of only 10° to 15° in the crank shaft. However, the inventive structure can be modified to allow or restrict free play over any desired range.

The braking operation, which is initiated by trying to lower the window manually via the drum, acts solely and only in the direction that is specified. This prevents the window from dropping due to causes other than manual operation (e.g., from irreversibility and from interruption or breakage), and in the meantime, the window can be raised manually. Thus, the inventive structure prevents the window from slowly descending on its own accord due to vibrations, bad roads, etc. During vibration and braking tests, window lowering due to free play of the system diminishes by about 50%. The inventive design also allows the crank-rotation drive system to function under reduced free driving torque (e.g., on the order of 0.2 Nm) and with very little free play in the crank shaft before driving the drum.

It should be understood that various alternatives to the embodiments of the invention described herein may be employed in practicing the invention. It is intended that the following claims define the scope of the invention and that the method and apparatus within the scope of these claims and their equivalents be covered thereby.

What is claimed is:

1. A braking system for a manual vehicle window-operating mechanism having a drum and a crank shaft that rotate relative to each other, the braking system comprising:

a helical spring having first and second winding ends; and a first radial side piece disposed at the first winding end and a second radial side piece disposed at the second winding end, wherein an included angle between the first and second radial side pieces is an acute angle, and wherein the first radial side piece is adapted for receipt in a slot in the crank shaft and the second radial side piece is adapted for disposition between the crank shaft and the drum.

2. The braking system of claim 1, wherein the acute angle between the first and second winding ends is less than 30°.

3. The braking system of claim 1, wherein the helical spring brakes the window-operating mechanism when the second radial side piece contacts the drum.

4. A manual vehicle window-operating mechanism, comprising:

a crank shaft;

a drum, wherein the crank shaft and the drum rotate relative to each other;

a helical spring having first and second winding ends and coaxially surrounding the crank shaft and the drum; and a first radial side piece disposed at the first winding end and a second radial side piece disposed at the second winding end, wherein an included angle between the first and second radial side pieces is an acute angle, and wherein the first radial side piece is disposed in a slot in the crank shaft and the second radial side piece is disposed between the crank shaft and the drum.

5. The window-operating mechanism of claim 4, wherein the acute angle between the first and second winding ends is less than 30°.

6. The window-operating mechanism of claim 4, wherein the crank shaft comprises at least one extension, wherein the slot is formed in said at least one extension.

7. The window-operating mechanism of claim 6, wherein said at least one extension comprises a first extension having the slot and a second extension that is diametrically opposite the first extension.

8. The window-operating mechanism of claim 4, wherein the helical spring brakes the window-operating mechanism when the second radial side piece contacts the drum.

* * * * *